United States Patent [19]

Kawase

[11] 4,415,887

[45] Nov. 15, 1983

[54] MAGNETRON FAULT ALARM IN A MICROWAVE OVEN

[75] Inventor: Yoshitaka Kawase, Nara, Japan

[73] Assignee: Sharp Kabushiki Kaisha, Osaka, Japan

[21] Appl. No.: 254,172

[22] Filed: Apr. 14, 1981

[30] Foreign Application Priority Data

Apr. 17, 1980 [JP] Japan ..... 55-51276

[51] Int. Cl.[3] ..... G08B 21/00; H05B 6/64

[52] U.S. Cl. ..... 340/635; 219/10.55 B; 219/10.55 C; 219/10.55 D; 307/528

[58] Field of Search ..... 340/635, 507, 611, 650, 340/687, 651, 652, 653, 660, 662, 663, 664; 219/10.55 B, 10.55 C, 10.55 D; 307/516, 518, 528, 510

[56] References Cited

U.S. PATENT DOCUMENTS 3,944,889 3/1976 Conway ..... 340/650 X 4,309,585 1/1982 Doi et al. ..... 340/687

*Primary Examiner*—John W. Caldwell, Sr.
*Assistant Examiner*—Daniel Myer
*Attorney, Agent, or Firm*—Birch, Stewart, Kolasch & Birch

[57] ABSTRACT

A microwave oven includes a plurality of magnetrons for cooking purposes. When at least one magnetron is placed in a fault condition, an indication lamp is enabled to display the fault condition. When the cooking operation is interrupted by opening the oven door while the cooking operation is performed, the indication lamp is held in the former state. That is, when the oven door is opened under the normal operation mode, the indication lamp is never enabled. When the oven door is opened under the condition where at least one magnetron is placed in the fault condition, the indication lamp is continuously enabled to continuously display the fault condition.

5 Claims, 7 Drawing Figures

| CONDI-TION | MGF 1 | MGF 2 | $\bar{S}$ | $\bar{R}$ | Q | DOOR | INDICATION LAMP-46- |
|---|---|---|---|---|---|---|---|
| 1 | H | H | H | L | L | H | OFF |
| 2 | H | L | L | H | H | H | ON |
| 3 | L | H | L | H | H | H | ON |
| 4 | L | L | H | H | $Q_o$ | H | HOLD THE FORMER STATE |
| 5 | H | H | H | L | L | L | OFF |
| 6 | H | L | L | H | H | L | OFF |
| 7 | L | H | L | H | H | L | OFF |
| 8 | L | L | H | H | $Q_o$ | L | OFF |

MAGNETRON FAULT ALARM IN A MICROWAVE OVEN

BACKGROUND AND SUMMARY OF THE INVENTION

The present invention relates to a microwave oven including a plurality of magnetrons and, more particularly, to a fault condition alarm system for indicating an alarm condition when at least one magnetron is placed in a fault condition.

There is a microwave oven which includes a plurality of magnetrons for cooking purposes. Now assume that the microwave oven includes n-number of magnetrons, each magnetron developing microwave energy of A watts. In such a microwave oven, if one magnetron is placed in a fault condition and does not operate, the total output energy becomes $$\frac{(n-1)}{n} \times A \text{ (watts).}$$

Accordingly, the cooking operation is not performed in a desired manner.

Accordingly, an object of the present invention is to provide an alarm system for indicating magnetron fault condition in a microwave oven including a plurality of magnetrons.

Another object of the present invention is to stabilize an operation mode of a microwave oven including a plurality of magnetrons.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a control system is provided for activating an alarm lamp when at least one magnetron is placed in a fault condition. The fault condition alarm display is continuously maintained even when a cooking operation is completed, whereby the operator can recognize the fault and lengthen the cooking period of the cooking operation.

In such an alarm system, there is a possibility that the control system erroneously detects the fault condition when the oven door is opened during cooking even though the magnetrons are in the normal operation mode. The above-mentioned erroneous detection is caused by a time delay between the opening of the oven door and the actuation of a door switch. The present control system includes a logic circuit for detecting existence of an actual fault condition.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
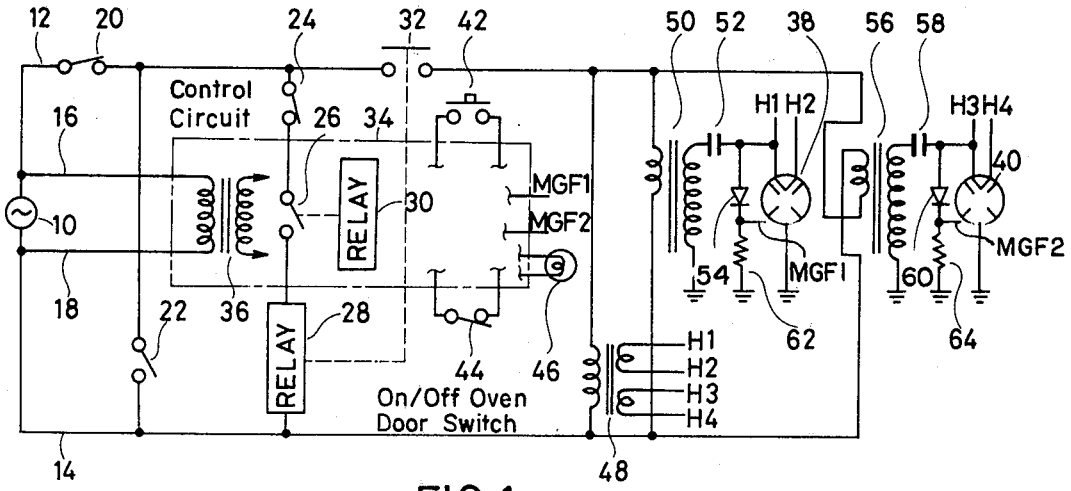
FIG. 1 is a schematic circuit diagram of an embodiment of a microwave oven of the present invention including two magnetrons, wherein an oven door is closed.

A microwave oven of the present invention is supplied with power from an A.C. power source 10 (ex, A.C. 100 V 50/60 Hz). A pair of power supply lines 12 and 14, and another pair of power supply lines 16 and 18 are connected to the A.C. power source 10. A first interlock switch 20 is connected to the power supply line 12, and the opposite side of the first interlock switch 20 is connected to the power supply line 14 via a monitor switch 22.

A series circuit including a second interlock switch 24, a relay switch 26 and a cook relay 28 is disposed between the pair of power supply lines 12 and 14. The relay switch 26 is controlled by a cook start relay 30, and the cook relay 28 controls another relay switch 32.

A control circuit block 34 is supplied with power from a power source transformer 36 of which the primary winding is connected to the pair of power supply lines 16 and 18. The control circuit block 34 includes a timer circuit for determining a cooking time period, an output energy variation circuit for intermittently energizing two magnetrons 38 and 40, thereby selecting the output energy between 0% and 100%, and a magnetron fault condition determination circuit. The control circuit block 34 is implemented by a central processor unit M 58840 manufactured by Mitsubishi Electric Corporation.

A cook start manual switch 42 is associated with the control circuit block 34 to instruct the initiation of the cooking operation. When the cook start manual switch 42 is actuated, the cook start relay 30 functions to close the relay switch 26. Then, the cook relay 28 is operated to close the relay switch 32. A door switch 44 is associated with an oven door so that the door switch 44 is closed when the oven door is closed and is opened when the oven door is opened. Various circuits included in the control circuit block 34 are enabled only when the door switch 44 is in the closed state.

An indication lamp 46 (or a light emitting diode) is connected to the magnetron fault condition determination circuit in order to display a fault condition when at least one of the magnetrons 38 and 40 is placed in a fault condition. A buzzer can be employed instead of the indication lamp 46 for audibly signaling the magnetron fault condition.

A heater transformer 48 is connected between the pair of power supply lines 12 and 14, which supplies predetermined voltages to heaters included in the magnetrons 38 and 40. A high voltage transformer 50 is connected between the pair of power supply lines 12 and 14 for activating the first magnetron 38. As is well known, a series circuit of a high voltage capacitor 52 and a high voltage diode 54 is connected to the secondary winding of the high voltage transformer 50 to establish the half-wave voltage doubler rectifying circuit. Another high voltage transformer 56, a high voltage capacitor 58 and a high voltage diode 60 are provided for activating the second magnetron 40.

Figure 2:
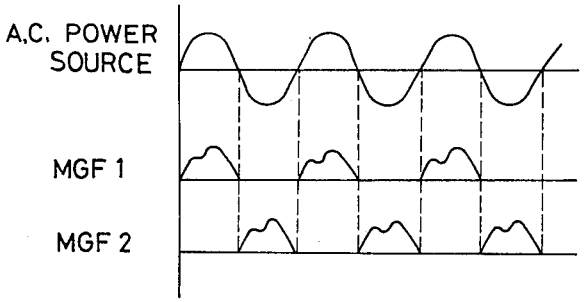
FIG. 2 is a timing chart illustrating the currents monitored from diodes included in magnetron power supply circuits for the two magnetrons of FIG. 1 in the normal operation mode.

A resistor 62 is connected to the high voltage diode 54, the node thereof developing a diode current signal $MGF_1$ which is applied to the control circuit block 34 for detection purposes. Another resistor 64 is connected to the high voltage diode 60 for developing a diode current signal $MGF_2$ indicating the operation mode of the second magnetron 40. When the two magnetrons 38 and 40 are in the normal operation modes, the diode current signals $MGF_1$ and $MGF_2$ show waveforms as shown in FIG. 2.

The above-mentioned first interlock switch 20, the second interlock switch 24, the monitor switch 22 and the door switch 44 are associated with the open/close movement of the oven door.

Figure 3:
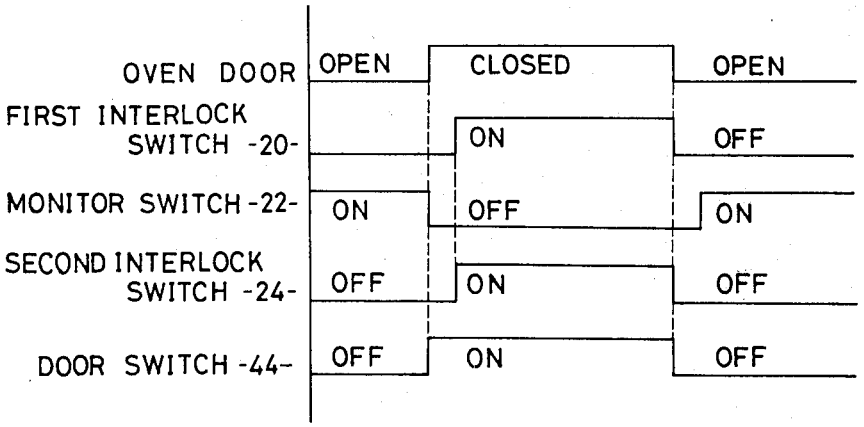
FIG. 3 is a time chart showing an ideal relationship between the oven door condition and switching operations of various switches included in the microwave oven of FIG. 1.

FIG. 3 shows an ideal relationship between the oven door condition and the switching operations of the first interlock switch 20, the monitor switch 22, the second interlock switch 24 and the door switch 44.

Figure 4:
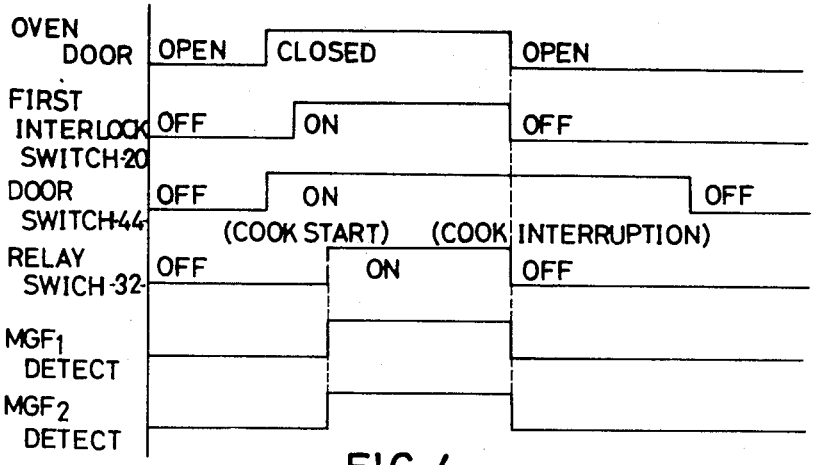
FIG. 4 is a time chart showing a relationship of various signals occurring within the microwave oven of FIG. 1 in an exemplified operation.

However, there is a possibility that the door switch 44 will remain closed for a while even though the first interlock switch 20 is opened when the oven door is opened while the cooking operation is performed as shown in the time chart of FIG. 4. This time delay is mainly caused by inaccurate adjustment of the switches, but such a time delay is almost inevitable. More specifically, if the operator desires to interrupt the cooking operation, the operator opens the oven door even though the cooking operation is being actually performed. The first interlock switch 20 is then switched off to terminate the microwave generation. In response thereto, the current signals $MGF_1$ and $MGF_2$ disappear. At this moment, if the door switch 44 is still held in the closed condition, the control circuit block 34 is held in the operative condition and, therefore, there is a possibility that the magnetron fault condition determination circuit will erroneously detect the fault condition of the magnetrons 38 and 40.

Figure 5:
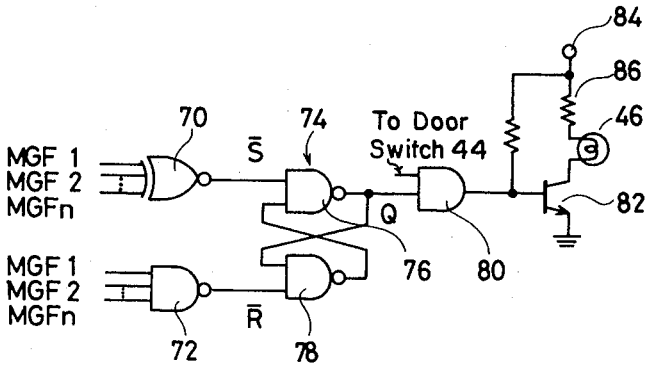
FIG. 5 is a block diagram of a magnetron fault condition determination circuit included in the microwave oven of FIG. 1.

To eliminate the above-mentioned erroneous operation, the magnetron fault condition determination circuit of the present invention is constructed as shown in FIG. 5, which is suited for a microwave oven including the n-number of magnetrons.

The magnetron fault condition determination circuit comprises a NOR gate 70 receiving diode current detection signals $MGF_1$ through $MGF_n$, and a NAND gate 72 receiving the diode current detection signals $MGF_1$ through $MGF_n$ (FIG. 2). Output signals of the NOR gate 70 and the NAND gate 72 are applied to a latch (flip-flop) 74 comprising NAND gates 76 and 78. The Q output of the flip-flop 74, which is derived from the NAND gate 76, is applied to one input terminal of an AND gate 80. The other input terminal of the AND gate 80 receives the ON/OFF signal derived from the door switch 44. An output signal of the AND gate 80 is supplied to the base electrode of a switching transistor 82. The collector electrode of the switching transistor 82 is connected to the D.C. power source 84 through a resistor 86 and the indication lamp 46. The ON/OFF signal derived from the door switch 44 bears a high level when the door switch 44 is ON, and bears a low level when the door switch 44 is OFF.

Figures 6, 7:
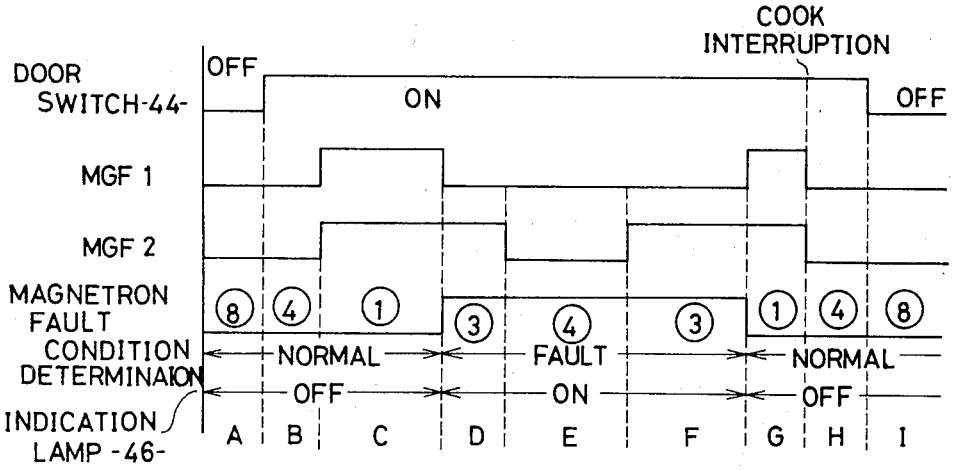
FIG. 6 is a truth table of the magnetron fault condition determination circuit of FIG. 5 when two magnetrons are employed.
FIG. 7 is a time chart showing the fault condition determination operation of the magnetron fault condition determination system of the present invention.

FIG. 6 shows a truth table of the magnetron fault condition determination circuit when two magnetrons are employed. In the truth table of FIG. 6, "H" represents the high level, and "L" represents the low level.

The condition 1 shows an operation mode where the magnetrons 38 and 40 (FIG. 1) are in the normal operation modes. The diode current detection signals $MGF_1$ and $MGF_2$ are high and, therefore, the Q output of the latch 74 is low. Thus, the output signal of the AND gate 80 is low and does not enable the indication lamp 46. The disabling of the indication lamp 46 indicates normal cooking operation. When the magnetron 40 is placed in a fault condition (condition 2), or when the magnetron 38 is placed in the fault condition (condition 3), the Q output of the latch 74 goes high to enable the indication lamp 46. When both of the magnetrons 38 and 40 are placed in the fault condition (condition 4), the Q output of the latch 74 maintains the former state (represented by $Q_0$) and, therefore, the display condition of the indication lamp 46 does not change. Thus, the magnetron fault condition determination circuit of the present invention enables the indication lamp 46 when at least one of the magnetrons is placed in the fault condition.

FIG. 7 shows the fault condition determination operation in an exemplified cooking operation. The determination is based on the truth table shown in FIG. 6. The conditions (1) through (8) correspond to the conditions 1 through 8 shown in FIG. 6.

The period A (condition (8) ) shows a condition where the oven door is opened to prepare the cooking, wherein the indication lamp 46 is not enabled. The period B shows a condition where the oven door is closed but the cook start manual switch 42 has not been actuated. The determination logic is placed in the condition (4) and, therefore, the indication lamp 46 holds the former state, namely, OFF. The period C shows the normal operation mode, wherein both of the magnetrons 38 and 40 are placed in the normal operation modes. When the magnetron 38 is placed in the fault condition at the period D, the determination logic becomes the condition (3) to enable the indication lamp 46. Under these conditions, when the magnetron 40 is further placed in the fault condition (period E), the determination logic becomes the condition (4) to hold the former state. Thus, the indication lamp 46 is held in the enabled state.

The period G shows the normal operation mode, wherein the indication lamp 46 is not enabled. Under these conditions, when the oven door is opened to interrupt the cooking operation, the magnetron energization is suddenly terminated but the door switch 44 is still held in the ON state (period H). The determination logic becomes the condition (4) to maintain the former state. Therefore, the indication lamp 46 is not enabled. If the cooking operation is interrupted by opening the oven door under the condition where the microwave oven is in the period F, the determination output maintains the output of the condition (3) . Therefore, the indication lamp 46 is enabled to continuously indicate the fault condition.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A fault condition alarm system in a microwave oven which includes an oven door, a plurality of magnetrons and a plurality of detection means associated with each of said plurality of magnetrons for developing a detection signal when the magnetron is placed in a fault condition, said fault condition alarm system comprising:

first determination means for developing a first determination signal when a said detection signal is not developed from any of said plurality of detection means, said first means developing a second determination signal when at least one detection signal is developed from one of said plurality of detection means;

door condition monitoring means for monitoring whether said oven door is open or closed;

second determination means responsive to said first determination means and said door condition monitoring means for developing a control signal when said second determination signal is developed and said door is determined to be closed; and display means responsive to said control signal derived from said second determination means.

2. The fault condition alarm system of claim 1, wherein said second determination means comprises AND gate means for receiving said first and second determination signals derived from said first determination means and a door condition signal developed by said door condition monitoring means.

3. The fault condition alarm system of claim 1 or 2, wherein said first determination means includes means for assuming that the state of said determination signal developed by said first determination means remains constant when a detection signal is developed by more than one of said plurality of detection means.

4. The fault condition alarm system of claim 1 or 2, wherein said second determination means includes means for maintaining the state of the control signal developed by said second determination means constant until a signal is developed by the door condition monitoring means.

5. The fault condition alarm system of claim 1 or 2, wherein said door condition monitoring means is a door switch.

* * * * *